US008317297B2

(12) United States Patent
Terada

(10) Patent No.: US 8,317,297 B2
(45) Date of Patent: Nov. 27, 2012

(54) INK-JET RECORDING APPARATUS

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 24 days.

(21) Appl. No.: 13/070,160

(22) Filed: Mar. 23, 2011

(65) Prior Publication Data

US 2011/0242210 A1 Oct. 6, 2011

(30) Foreign Application Priority Data

Mar. 31, 2010 (JP) ..... 2010-080492

(51) Int. Cl.
*B41J 23/00* (2006.01)

(52) U.S. Cl. ..... 347/37; 347/8; 347/38; 347/39

(58) Field of Classification Search ..... 347/8, 37, 347/38, 39; 400/55, 283
See application file for complete search history.

(56) References Cited

U.S. PATENT DOCUMENTS

| | | | |
|---|---|---|---|
| 5,373,312 | A | 12/1994 | Fujioka et al. |
| 5,530,466 | A | 6/1996 | Fujioka et al. |
| 5,646,653 | A | 7/1997 | Fujioka et al. |
| 5,646,668 | A | 7/1997 | Fujioka et al. |

FOREIGN PATENT DOCUMENTS

| | | | |
|---|---|---|---|
| JP | H03-021458 | A | 1/1991 |
| JP | H04-039076 | A | 2/1992 |
| JP | H07-061078 | A | 3/1995 |
| JP | H07-156483 | A | 6/1995 |
| JP | H10-250057 | A | 9/1998 |
| JP | 2000-025290 | A | 1/2000 |
| JP | 2001-253060 | A | 9/2001 |
| JP | 2004-066540 | A | 3/2004 |

OTHER PUBLICATIONS

Japan Patent Office, Decision to Grant a Patent for Japanese Patent Application No. 2010-080492 (counterpart Japanese Patent Application), mailed Aug. 7, 2012.

*Primary Examiner* — Matthew Luu
*Assistant Examiner* — Henok Legesse
(74) *Attorney, Agent, or Firm* — Baker Botts L.L.P.

(57) ABSTRACT

An ink-jet recording apparatus is provided, the ink-jet recording apparatus including an ink-jet head, a first carriage on which the ink-jet head is carried, a guide member, a moving mechanism which moves the first carriage along the guide member, a transport mechanism which transports a medium along a transport surface, and a second carriage which is reciprocatively movable while following movement of the first carriage and which is constructed relatively movably in a direction perpendicular to the transport surface with respect to the first carriage. The second carriage has a protective member which protects a jetting surface from the medium and a regulating member which regulates movement of the second carriage in relation to a third direction.

12 Claims, 7 Drawing Sheets

INK-JET RECORDING APPARATUS

CROSS REFERENCE TO RELATED APPLICATION

The present application claims priority from Japanese Patent Application No. 2010-080492, filed on Mar. 31, 2010, the disclosure of which is incorporated herein by reference in its entirety.

BACKGROUND OF THE INVENTION

1. Field of the Invention

The present invention relates to an ink-jet recording apparatus for jetting an ink or inks from nozzles.

2. Description of the Related Art

In an ink-jet printer described in Japanese Patent Application Laid-open No. 7-61078, runners or rollers, which are rotatably supported by shafts extending in a direction perpendicular to a scanning direction, are arranged respectively at both end portions in relation to the scanning direction of a carriage which is reciprocatively movable in the scanning direction and on which a printing head is carried. The recording paper is pressed downwardly by the rollers. Accordingly, the recording paper is prevented from causing the floating-up which would be otherwise caused, for example, by the swelling brought about by the landing of the ink during the printing. Owing to the prevention of the floating-up of the recording paper, the recording paper is prevented, for example, from being brought in contact with an ink jetting surface of the printing head.

SUMMARY OF THE INVENTION

The carriage, which is reciprocatively movable in the scanning direction, usually has a clearance or play which is provided in a direction perpendicular to the scanning direction and the transport direction of the recording paper, in order to decrease the sliding resistance with respect to a guide member for guiding the carriage. Therefore, when the rollers are provided for the carriage as in the ink-jet printer described above, it is feared that the carriage, which is provided with the rollers, may be moved in the separating direction to make separation from the transport surface for the recording paper by the force which is allowed to act on the rollers from the recording paper when the recording paper intends to float up.

If the carriage is moved in the separating direction to make separation from the transport surface for the recording paper, it is feared that the meniscus of the nozzle may be destroyed by the acceleration brought about when the carriage is moved in the separating direction to make separation from the transport surface and/or that the distance between the jetting surface and the recording paper may be varied or fluctuated to deteriorate the printing quality.

If the carriage is moved as described above, it is feared that the carriage may be caught by a sliding portion of the guide member and/or the frictional force may be varied or fluctuated between the carriage and the guide member due to the fluctuation of a sliding surface on which the carriage and the guide member perform the sliding movement. Further, when the carriage is moved by a belt attached to the carriage, it is feared that the tension angle of the belt may be varied or fluctuated, and the velocity of movement of the carriage may be varied or fluctuated. If the velocity of movement of the carriage is varied or fluctuated, it is feared that the printing quality may be lowered.

An object of the present invention is to provide an ink jet recording apparatus which is provided with a protective member for preventing the recording paper from being brought in contact with a jetting surface of an ink-jet head and which simultaneously makes it possible to prevent a carriage from being moved in the separating direction to make separation from a transport surface for the recording paper by the force allowed to act on the protective member from the recording paper.

According to a first aspect of the present invention, there is provided an ink-jet recording apparatus which jets liquid droplets of an ink onto a medium to perform recording, including:

an ink-jet head having a jetting surface on which a plurality of nozzles through which the ink is jetted is formed;

a first carriage on which the ink-jet head is mounted;

a guide member which extends in a first direction parallel to the jetting surface;

a moving mechanism which reciprocatively moves the first carriage in the first direction along the guide member;

a transport mechanism which transports the medium in a second direction perpendicular to the first direction along a transport surface which faces the jetting surface and which is parallel to the first direction; and a second carriage which is reciprocative), movable in the first direction while following movement of the first carriage and which is relatively movable in a third direction perpendicular to the transport surface with respect to the first carriage, the second carriage including:

a protective member which is arranged on one side of the ink-jet head in the first direction to protect the jetting surface from the medium; and a regulating member which regulates movement of the second carriage in the third direction so that a nearest portion of the protective member, which is provided with respect to the transport surface, is always disposed nearer to the transport surface as compared with the jetting surface in the third direction.

According to the inkjet recording apparatus concerning the first aspect of the present invention, the movement of the second carriage in relation to the third direction is regulated by the regulating member. Therefore, the nearest portion of the protective member, which is provided with respect to the transport surface, is always disposed at a position nearer to the transport surface as compared with the jetting surface. Therefore, even when the medium such as the recording paper or the like is bent or curled in the separating direction to make separation from the transport surface in the third direction, the medium is brought in contact with the protective member which is disposed nearer to the transport surface as compared with the jetting surface in relation to the third direction. Accordingly, it is possible to prevent the recording paper from being brought in contact with the jetting surface.

Further, in this situation, the second carriage, which is provided with the protective member, is constructed relatively movably in the third direction with respect to the first carriage, and the movement in relation to the third direction is regulated by the regulating member so that the nearest portion of the protective member, which is provided with respect to the transport surface, is always disposed nearer to the transport surface as compared with the jetting surface in relation to the third direction. Therefore, when the medium such as the recording paper or the like is bent in the separating direction to make separation from the transport surface in the third direction, and the protective member is pressed in this direction, then the second carriage is relatively moved in the separating direction to make separation from the transport surface in the third direction with respect to the first carriage. In another situation, the movement of the second carriage is regulated by the regulating member, and the second carriage is not moved. In any case thereof, the first carriage can be prevented from being moved in the separating direction to make separation from the transport surface in the third direction, which would be otherwise moved by the force of the recording paper to press the protective member.

DESCRIPTION OF THE PREFERRED EMBODIMENTS

A preferred embodiment of the present invention will be explained below.

Figure 1:
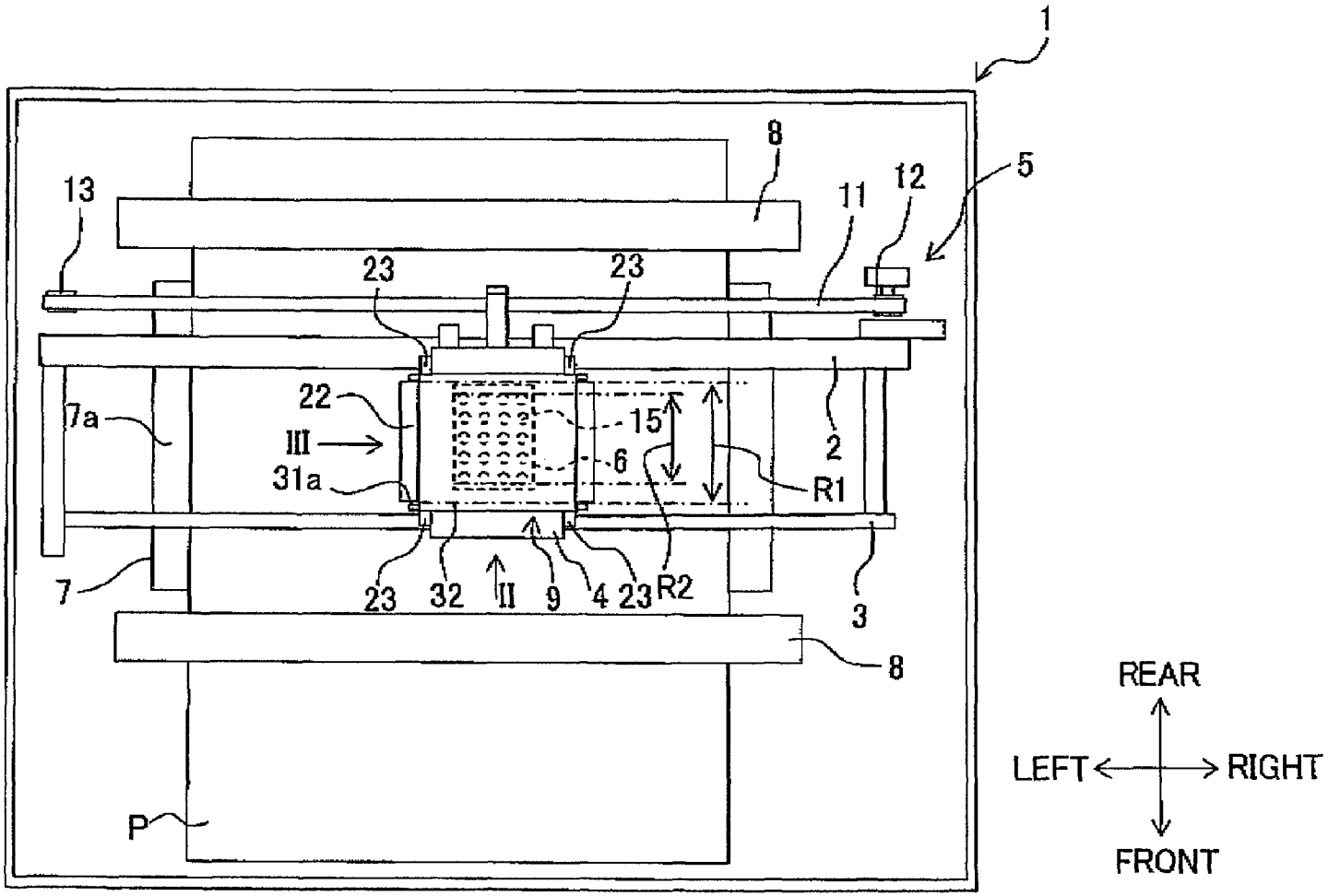
FIG. 1 shows a schematic arrangement illustrating a printer according to an embodiment of the present invention.
Figure 2:
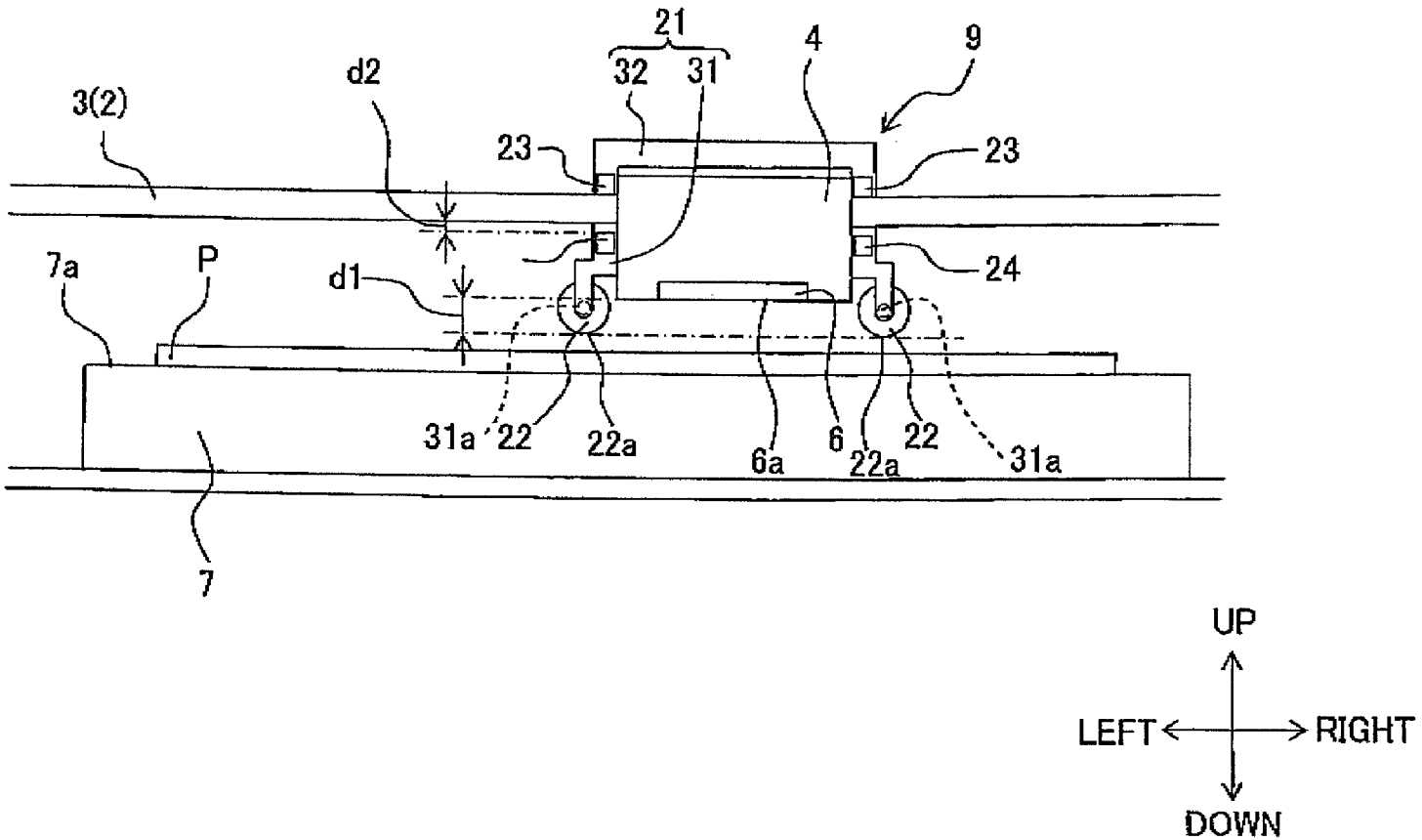
FIG. 2 shows a view in which those shown in FIG. 1 are viewed in a direction of an arrow II.
Figure 3:
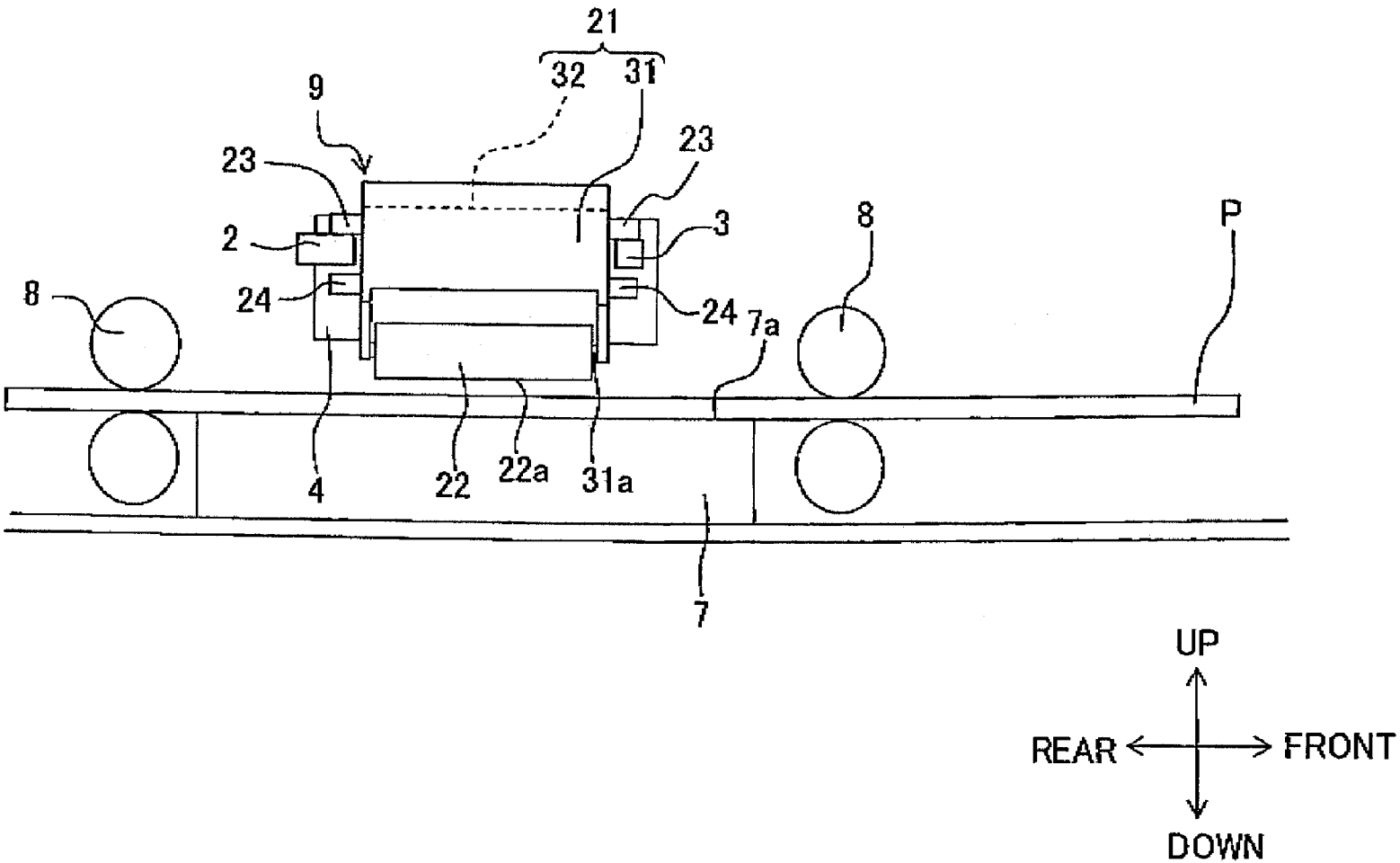
FIG. 3 shows a view in which those shown in FIG. 1 are viewed in a direction of an arrow III.

The following description will be made assuming that the left-right direction (first direction), the front-back direction (second direction), and the up-down direction (third direction), which are perpendicular to one another, are defined as shown in FIGS. 1 to 3.

As shown in FIGS. 1 to 3, a printer 1 (ink-jet recording apparatus) includes, for example, two guide rails 2, 3 (guide members), a first carriage 4, a moving mechanism 5, an ink-jet head 6, a platen 7, transport rollers 8 (transport mechanisms), and a second carriage 9.

The two guide rails 2, 3 extend in the left-right direction in parallel to one another. The first carriage 4 is supported by the two guide rails 2, 3. The first carriage 4 can be reciprocatively moved in the left-right direction along the guide rails 2, 3. In this arrangement, a clearance or play is provided to some extent in the up-down direction between the first carriage 4 and the guide rails 2, 3 so that the first carriage 4 can be smoothly moved in the left-right direction.

The moving mechanism 5 includes an endless belt 11 to which the first carriage 4 is fixed, and two pulleys 12, 13 around which the belt 11 is wound. When the pulley 12 is rotated in the both directions by means of an unillustrated motor connected to the pulley 12, the belt 11 is rotated in the both directions (normal and inverse directions, CW and CCW directions). Accordingly, the first carriage 4, which is fixed to the belt 11, is reciprocatively moved in the left-right direction. In this situation, the pulley 13 is rotated by the rotation of the belt 11.

The ink-jet head 6 is arranged on the lower surface of the first carriage 4. A plurality of nozzles 15 are arranged on a jetting surface 6*a* which is the lower surface of the ink-jet head 6 and which extends in the front-back direction and the left-right direction. An ink or inks is/are jetted from the nozzles 15.

The platen 7 is arranged under or below the first carriage 4. A plurality of unillustrated ribs are formed on the upper surface of the platen 7 (surface facing the jetting surface 6*a*). The plurality of ribs reduce the contact area between the recording paper and the platen 7 to decrease the friction with respect to the recording paper. A virtual surface, which is defined by the forward end portions of the plurality of ribs, is a transport surface 7*a* on which the recording paper P is transported. The transport surface 7*a* is parallel to the front-back direction and the left-right direction. In other words, the transport surface 7*a* is parallel to the jetting surface 6*a* of the ink-jet head 6. The transport rollers 8 are arranged on the both front and back sides of the platen 7 to transport the recording paper P in the frontward direction. Accordingly, the recording paper P is transported along the transport surface 7*a*. In this situation, the recording paper P is supported by the transport surface 7*a*.

In the printer 1, the ink or inks is/are jetted from the ink-jet head 6 which is reciprocatively movable in the left-right direction together with the first carriage 4, to the recording paper P which is transported in the frontward direction by the transport rollers 8, and thus the printing is performed on the recording paper P.

The second carriage 9 is supported by the guide rails 2, 3. The second carriage 9 includes, for example, a frame 21 (connecting member), two rollers 22 (protective members), and protrusions 23, 24 (contacting portions or abutment portions).

The frame 21 is composed of an elastic material such as a synthetic resin material or the like. The frame 21 is provided with two support sections 31 and a connecting section 32. The two support sections 31 are arranged to abut against the side surfaces of the first carriage 4 in relation to the left-right direction on the both sides of the first carriage 4 in relation to the left-right direction. Each of the two support sections 31 extends in the up-down direction. Shafts 31*a*, which extend in the front-back direction respectively, are provided at the lower end portions of the respective support sections 31. The rollers 22 are rotatably supported by the shafts 31*a*. Accordingly, the rollers 22 are arranged on the both sides of the ink-jet head 6 in relation to the left-right direction. Further, the rollers 22 extend over a range TU which is wider than a range R2 in which the nozzles 15 are arranged.

The connecting section 32 is positioned over or above the first carriage 4. The connecting section 32 mutually connects the upper end portions of the two support sections 31. Accordingly, the two rollers 22, which are supported by the shafts 31*a* of the two support sections 31, are connected to one another by the aid of the frame 21.

In this way, the second carriage 9 is constructed so that the pair of rollers 22, which are arranged on the both sides of the first carriage 4 in relation to the left-right direction, are connected by the frame 21. Therefore, the rotation of the support section 31 about the axis in the front-back direction, i.e., the swinging movement of the support section 31 about the axis in the front-back direction is easily constrained as compared with a case in which the roller 22 is arranged on only one side in the left-right direction. Therefore, the attitude of the second carriage 9 is stabilized.

When the first carriage 4 is moved in the rightward direction, then the right support section 31 is pushed by the first carriage 4, and thus the second carriage 9 is moved in the rightward direction. On the other hand, when the first carriage 4 is moved in the leftward direction, then the left support section 31 is pushed by the first carriage 4, and thus the second carriage 9 is moved in the leftward direction. In this way, when the first carriage 4 is reciprocatively moved in the left-right direction, the second carriage 9 is reciprocatively moved in the left-right direction while following the movement of the first carriage.

Further, the support sections 31 of the frame 21 cause the sliding movement with respect to the side surfaces of the first carriage 4 in relation to the left-right direction. Therefore, the second carriage 9 is movable in the up-down direction. Accordingly, the second carriage 9 is relatively movable in the up-down direction with respect to the first carriage 4.

In this embodiment, when the second carriage 9 is not arranged to surround the first carriage 4, that is, before the second cartridge 9 is arranged to surround the first carriage 4, the spacing distance between the two support sections 31 of the frame 21 is narrowed at positions separated farther from the connecting portions with respect to the connecting section 32. The frame 21 is arranged on the first carriage 4 in an elastically deformed state so that the spacing distance between the two support sections 31 is approximately constant.

The two support sections 31 are pressed against the side surfaces of the first carriage 4 in the left-right direction by the force of the elastically deformed frame 21 to cause the restoration into the original state. Accordingly, it is possible to avoid any backlash of the second carriage 9 in the left-right direction when the first carriage 4 and the second carriage 9 are reciprocatively moved in the left-right direction. Further, in this situation, the force, by which the two support sections 31 are pressed against the side surfaces of the first carriage 1, is not large so much. Therefore, the sliding movement of the support sections 31 along the side surfaces of the first carriage 4 is not greatly inhibited by the force.

Alternatively, the frame 21 may be constructed beforehand so that gaps are formed between the two support sections 31 and the first carriage 4 when the second carriage 9 is arranged on the first carriage 4. Elastic members may be arranged so that the gaps are filled therewith. Accordingly, it is also allowable to avoid the backlash of the second carriage 9 in the left-right direction. Also in this arrangement, the elastic member may be selected so that the pressing load and the coefficient of friction can be appropriately set between the support section 31 and the first carriage 4. Accordingly, it is possible to construct the second carriage 9 so that the sliding movement of the support sections 31 along the side surfaces of the first carriage 4 is not greatly inhibited.

The protrusions 23 are formed at portions positioned over or above the guide rails 2, 3 respectively on the both side surfaces of each of the support sections 31 in relation to the front-back direction. Further, the protrusions 24 (regulating members) are formed at portions positioned under or below the guide rails 2, 3 on the both side surfaces of each of the support sections 31.

Accordingly, the second carriage 9 cannot be moved downwardly from the position at which the lower surfaces of the protrusions 23 abut against the upper surfaces of the guide rails 2, 3. That is, when the lower surfaces of the protrusions 23 abut against the upper surfaces of the guide rails 2, 3, the second carriage 9 (rollers 22) is in such a state that the second carriage 9 (rollers 22) is disposed most closely to the transport surface 7*a*. In this state, the jetting surface 6*a* and the lower ends 22*a* of the rollers 22 (nearest portions provided with respect to the transport surface 7*a*) are separated from each other by the distance d1 (first distance) in relation to the upward-downward direction.

The second carriage 9 cannot be moved upwardly from the position at which the upper surfaces of the protrusions 24 abut against the lower surfaces of the guide rails 2, 3. That is, the second carriage 9 (rollers 22) is separated farthest from the transport surface 7*a* in the state in which the protrusions 24 abut against the lower surfaces of the guide rails 2, 3.

Therefore, the second carriage 9 is relatively movable in the up-down direction with respect to the first carriage 4 between the position at which the lower surfaces of the protrusions 23 are brought in contact with the upper surfaces of the guide rails 2, 3 and the position at which the upper surfaces of the protrusions 24 are brought in contact with the lower surfaces of the guide rails 2, 3. Accordingly, the second carriage 9 is relatively movable with respect to the first carriage 4 by the distance d2 (second distance) defined by the difference between the distance which is provided in relation to the up-down direction between the lower surfaces of the protrusions 23 and the upper surfaces of the protrusions 24 and the length of the guide rails 2, 3 which is provided in relation to the up-down direction.

In this embodiment, for example, the positions of the protrusions 23, 24 are determined so that the distance d2 is smaller than the distance d1. Accordingly, as described above, the lower ends 22*a* of the rollers 22 are positioned downwardly from the jetting surface 6*a* even in such a state that the upper surfaces of the protrusions 24 abut against the lower surfaces of the guide rails 2, 3 and that the second carriage 9 is disposed at the position separated farthest from the transport surface 7*a*.

That is, the protrusions 23, 24 regulate the movement of the second carriage 9 in relation to the up-down direction so that the lower ends 22*a* of the rollers 22 are always disposed nearer to the transport surface 7*a* as compared with the jetting surface 6*a* in relation to the up-down direction. At the same time, the second carriage 9 is arranged to overlap a part of the first carriage 4 in relation to the up-down direction. Therefore, the first carriage 4 is regulated for movement in the separating direction to make separation from the guide rails 2, 3, since the second carriage 9 is regulated for the movement in the separating direction to make separation from the guide rails 2, 3.

Next, an explanation will be made about the operation of the second carriage 9 when the bending arises in the recording paper P during the printing.

In this arrangement, the recording paper P, which is transported on the transport surface 7*a*, is bent or curled upwardly (in the separating direction to make separation from the transport surface 7*a* in the third direction) in some cases, when the printing is performed by using the printer 1. Specifically, for example, the curling as described above arises in the recording paper P, for example, when the recording paper P swells by absorbing the ink jetted from the ink-jet head 6 and landed thereon. If the curled recording paper P is brought in contact with the jetting surface 6*a* of the ink-jet head 6, any problem arises, for example, such that the jetting surface 6*a* is damaged.

In view of the above, in this embodiment, the rollers 22 are arranged on the both sides in relation to the left-right direction of the first carriage 4. The lower ends 22*a* of the rollers 22 are always disposed at the positions nearer to the transport surface 7*a* as compared with the jetting surface 6*a*. Accordingly, the recording paper P, which is curled upwardly, is not brought in contact with the jetting surface 6*a*, but the recording paper P is brought in contact with the lower ends 22*a* of the rollers 22 positioned downwardly from the jetting surface 6*a*. Accordingly, it is possible to prevent the recording paper P from being brought in contact with the jetting surface 6*a*.

The rollers 22, which make contact with the recording paper P, are rotatably supported by the shafts 31*a*. The rollers 22 themselves are rotated when the first carriage is moved in the left-right direction in the state in which the recording paper P is brought in contact with the circumferential surfaces of the rollers 22. Therefore, moving the rollers 22 so that the circumferential surfaces of the rollers 22 rub the surface of the recording paper P is prohibited. Therefore, even when the ink is adhered to the rollers 22 on account of the contact of the recording paper P with the rollers 22, the circumferential surfaces of the rollers 22, to which the ink is adhered, do not rub the surface of the recording paper P. It is possible to prevent the recording paper P from being dirtied.

As described above, when the recording paper P is bent or curled on account of the swelling caused by absorbing the ink, the recording paper P is curled especially while swelling immediately after the landing of the ink. However, in this embodiment, as described above, the rollers 22 extend over the range R1 which is wider than the range R2 in which the nozzles 15 are arranged, in relation to the front-back direction. Therefore, the curled recording paper P is reliably brought in contact with the lower ends 22*a* of the rollers 22. Therefore, it is possible to reliably prevent the recording paper P from being brought in contact with the jetting surface 6*a*.

If it is merely considered to avoid the contact of the recording paper P with the jetting surface 6*a*, it is also conceived that the rollers 22 are provided for the first carriage 4 without providing the rollers 22 for the second carriage 9, unlike the embodiment of the present teaching.

However, if the rollers 22 are provided for the first carriage 4 unlike the embodiment of the present teaching, the following troubles may occur. For example, when the recording paper P is brought in contact with the rollers 22, then the force in the upward direction, which is allowed to act on the rollers 22 from the recording paper P, is also allowed to act on the first carriage 4 provided with the rollers 22. The clearance or play is provided as described above in the up-down direction between the first carriage 4 and the guide rails 2, 3. Therefore, if the force in the upward direction is allowed to act on the first carriage 4, the first carriage 4 is moved upwardly (in the separating direction to make separation from the transport surface 7*a* in the third direction).

If the first carriage 4 is moved upwardly, it is feared that the meniscus of the nozzle 15 may be destroyed by the acceleration provided in this situation and/or that the distance between the jetting surface 6*a* and the recording paper P may be fluctuated to deteriorate the printing quality. As for the fluctuation of the distance between the jetting surface 6*a* and the recording paper P, the period of time, which is required for the first carriage once lifted upwardly to lower and return again, depends on, for example, the free fall velocity, the frictional resistance, and the tensile force of the belt. Therefore, the first carriage 4 cannot necessarily follow the upward/downward fluctuation of the surface of the recording paper P in synchronization. As explained above, if the first carriage 4 is moved upwardly, the distance between the jetting surface 6*a* and the recording paper P is fluctuated.

Further, if the first carriage 4 is moved upwardly, the following situations are caused in some cases. That is, the first carriage 4 may be caught by any sliding portions of the guide rails 2, 3; the frictional force between the first carriage 4 and the guide rails 2, 3 may be fluctuated due to the fluctuation of the sliding surfaces for the sliding movement of the first carriage 4 and the guide rails 2, 3; and/or the angle, at which the first carriage 4 pulls the belt 11 of the moving mechanism 5, may be fluctuated. In such situations, it is feared that the velocity of movement of the first carriage 4 may be fluctuated. If the velocity of movement of the first carriage 4 is fluctuated, it is feared that the printing quality may be consequently lowered.

Figure 4A:
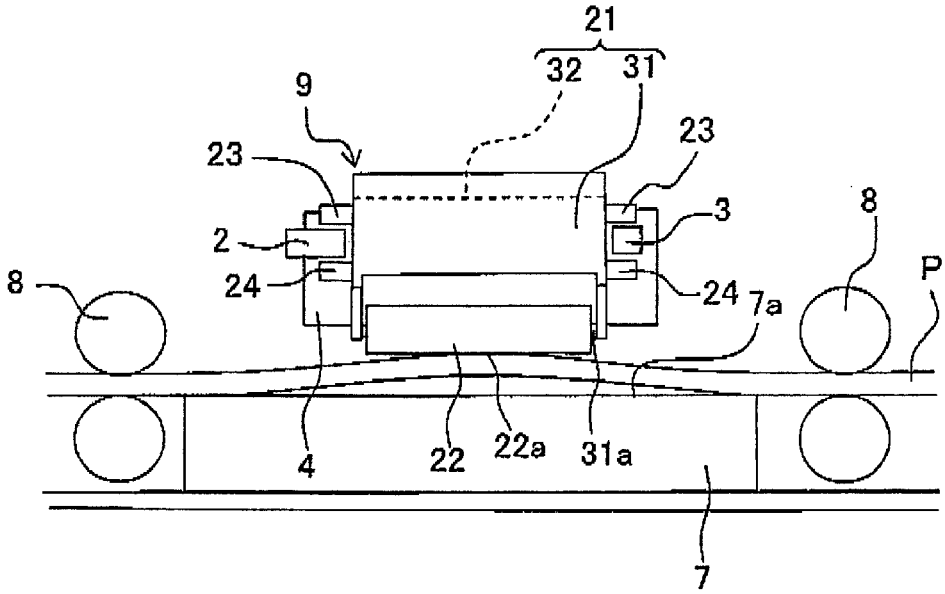
FIG. 4A shows situation in which the second carriage is moving upwardly when the recording paper is bent.

In view of the above, in this embodiment as described above, the second carriage 9 is provided, which is provided with the rollers 22 and which is relatively movable in the up-down direction with respect to the first carriage 4. Accordingly, when the recording paper P is curled upwardly, the recording paper P is brought in contact with the rollers 22, and the force in the upward direction is allowed to act on the rollers 22 from the recording paper P, then the second carriage 9 is moved upwardly until the upper surfaces of the protrusions 24 abut against the lower surfaces of the guide rails 2, 3 as shown in FIG. 4A. However, the second carriage 9 is relatively movable in the up-down direction with respect to the first carriage 4. Therefore, even when the second carriage 9 is moved upwardly, the first carriage 4 is not moved upwardly.

Figure 4B:
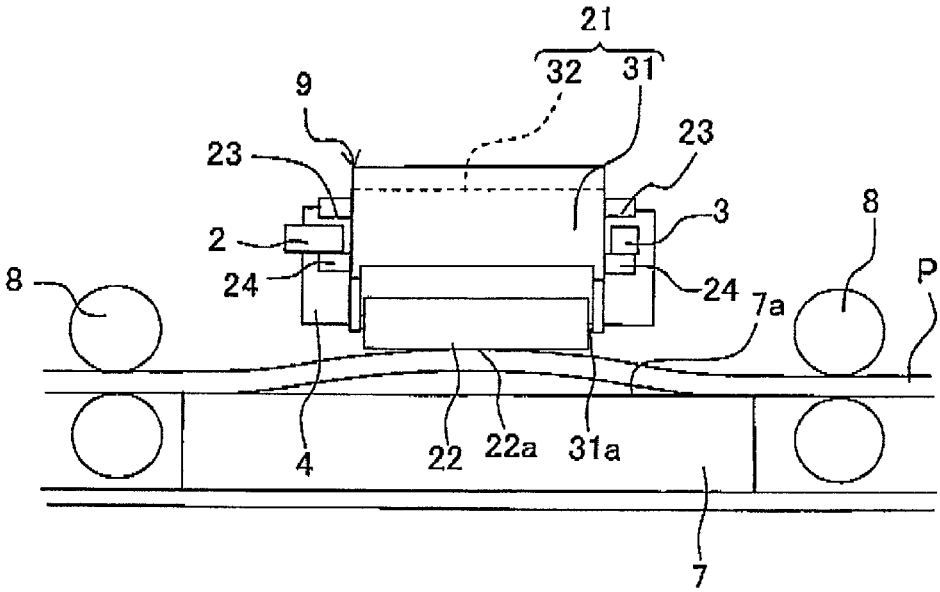
FIG. 4B shows situation in which the second carriage is regulated from moving upwardly.
Figure 4B:
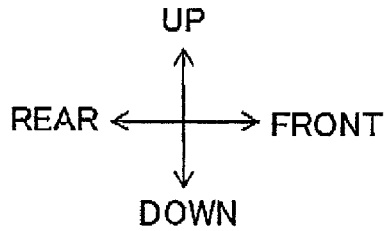

As shown in FIG. 4B, the upward movement is not caused any more as described above after the upper surfaces of the protrusions 24 abut against the lower surfaces of the guide rails 2, 3. In this situation, the force, which is allowed to act on the rollers 22 from the recording paper P, is received by the guide rails 2, 3, and the force is not transmitted to the first carriage 4. Therefore, the first carriage 4 is not moved upwardly by the force.

Further, in this situation, the second carriage 9 is moved in the up-down direction, but the movement in the up-down direction is regulated by the protrusions 23, 24 as described above. Therefore, the lower ends 22*a* of the rollers 22 are always positioned downwardly from the jetting surface Ga. Therefore, it is possible to reliably prevent the curled recording paper P from being brought in contact with the jetting surface 6*a*.

In this arrangement, the position of the first carriage 4, which relates to the up-down direction, is fluctuated depending on the accuracy of form of the guide rails 2, 3. On the other hand, the positions of the rollers 22, which relate to the up-down direction, are fluctuated depending on the accuracy of form of the members against which the protrusions 23, 24 abut. However, in this embodiment, the movement of the protrusions 23, 24 is regulated by the abutment of the protrusions 23, 24 against the guide rails 2, 3 which guide the first carriage 4. Therefore, the position of the first carriage 4 in relation to the up-down direction and the positions of the rollers 22 in relation to the up-down direction are fluctuated in approximately the same amount in the same direction depending on the accuracy of form of the guide rails 2, 3. Therefore, even when the positions of the rollers 22 and the first carriage 4 in relation to the up-down direction are fluctuated depending on the accuracy of form of the guide rails 2, 3, it is possible to retain the constant positional relationship in relation to the up-down direction between the rollers 22 and the first carriage 4.

Accordingly, it is possible to easily retain the constant positional relationship in relation to the up-down direction between the first carriage 4 and the rollers 22 as compared with a case in which the movement of the protrusions 23, 24 is regulated by the abutment of the protrusions 23, 24 against any member distinct from the guide rails 2, 3.

Further, it is unnecessary that any member, against which the protrusions 23, 24 abut, should be provided for the printer 1 distinctly from the guide rails 2, 3. Therefore, the arrangement of the printer 1 is simplified.

In this specification, the description or expression such as "parallel" and "perpendicular", which represents the geometrical positional relationship, is not necessarily limited to the ideal positional relationship in relation to respective structures or arrangements. The description or expression, which represents the geometrical positional relationship as described above, also includes such cases that the ideal positional relationship is not provided within a scope or range in which the gist or characteristics of the present teaching are not affected, for example, for any reason of the accuracy of any part. In other words, the expressions such as "parallel" and "perpendicular", which are referred to in the description of this specification and claims, include the meanings of "substantially parallel" and "substantially perpendicular".

Next, modified embodiments, in which various modifications are applied to the embodiment of the present teaching, will be explained. However, those constructed in the same manner as those of the embodiment of the present teaching are appropriately omitted from the explanation.

First Modified Embodiment

Figure 5:
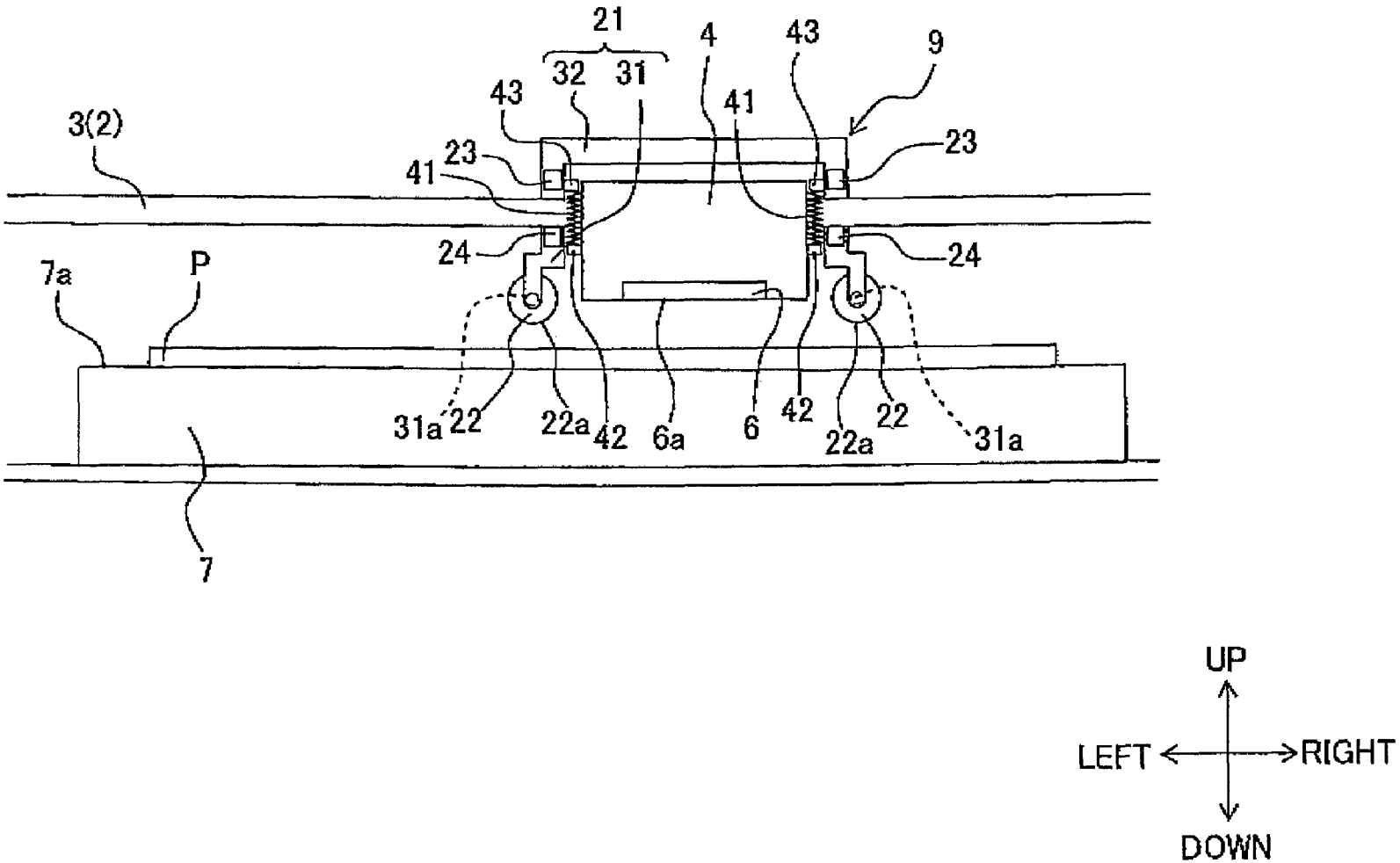
FIG. 5 shows a first modified embodiment corresponding to FIG. 2.

In a first modified embodiment, as shown in FIG. 5, a connecting section 32 of a frame 21 is prolonged or elongated in the left-right direction as compared with the embodiment described above, and spaces are provided between the first carriage 4 and two support sections 31 of the frame 21. Compression springs 41 (biasing members), which extend in the up-down direction, are arranged in the spaces respectively.

The lower ends of the compression springs 41 are attached to spring attachment sections 42 provided on the side surfaces in relation to the left-right direction of the first carriage 4. Further, the upper ends of the compression springs 41 are attached to spring attachment sections 43 provided on the side surfaces of the support sections 31 disposed on the side of the first carriage 4. Accordingly, the second carriage 9 is biased by the compression springs 41 upwardly (in the separating direction to make separation from the transport surface 7*a* in the third direction). A state is given, in which the upper surfaces of the protrusions 24 always abut against the lower surfaces of the guide rails 2, 3.

In this arrangement, the second carriage 9 is biased upwardly by the compression springs 41, and the second carriage 9 is not lowered downwardly from the position at which the upper surfaces of the protrusions 24 abut against the lower surfaces of the guide rails 2, 3. Therefore, it is possible to prevent the rollers 22 from being brought in contact, for example, with the recording paper P in the uncurled state and the transport surface 7*a* of the platen 7.

In this arrangement, the upper surfaces of the protrusions 24 always abut against the lower surfaces of the guide rails 2, 3. Even when the recording paper P is curled and brought in contact with the rollers 22, the second carriage 9 is not moved. Therefore, it is possible to always retain a constant distance in relation to the up-down direction between the transport surface 7*a* and the lower ends 22*a* of the rollers 22.

In the first modified embodiment, the compression springs 41, which upwardly urge or bias the second carriage 9 that is reciprocatively movable in the left-right direction, are supported by the first carriage 4 which is reciprocatively movable in the left-right direction together with the second carriage 9. Therefore, the first carriage 4 is biased by the compression springs 41 downwardly from the guide rails 2, 3 (in the approaching direction to make approach to the transport surface 7*a* in relation to the third direction). Therefore, owing to the biasing force, it is also possible to avoid the upward movement of the first carriage 4, which would be otherwise caused, for example, by the vibration during the movement.

In the first modified embodiment, the second carriage 9 is biased upwardly by the compression springs 41. However, the second carriage 9 may be biased upwardly by any other biasing member such as a tension spring, any elastic member other than the spring or the like, and the first carriage may be biased downwardly by means of the reaction thereof.

In the embodiment described above, the connecting section 32 of the frame 21 is arranged over or above the first carriage 4, and the upper end portions of the two support sections 31 are connected to one another by the connecting section 32. However, the present teaching is not limited to such an arrangement. For example, the connecting section may be arranged in front of the first carriage 4 to connect the front end portions of the two support sections to one another. Alternatively, the connecting section may be arranged at the back of the first carriage 4 to connect the backward end portions of the support sections 31 to one another. In this way, portions other than the upper end portions of the two support sections 31 may be connected to one another.

Further, there is no limitation to such connection that the connecting section connects the two support sections 31 at one place. For example, the connecting sections may be arranged both in front of and at the back of the first carriage to connect both of the front end portions and the backward end portions of the support sections 31 to one another. In this way, the connecting sections may connect the two support sections 31 to one another at a plurality of places.

Second Modified Embodiment

In the embodiment described above, the pair of rollers 22, which are arranged on the both sides in relation to the left-right direction of the first carriage 4, are provided on the same second carriage 9, and the pair of rollers 22 are connected to one another by the frame 21. However, the present teaching is not limited to such an arrangement.

Figure 6:
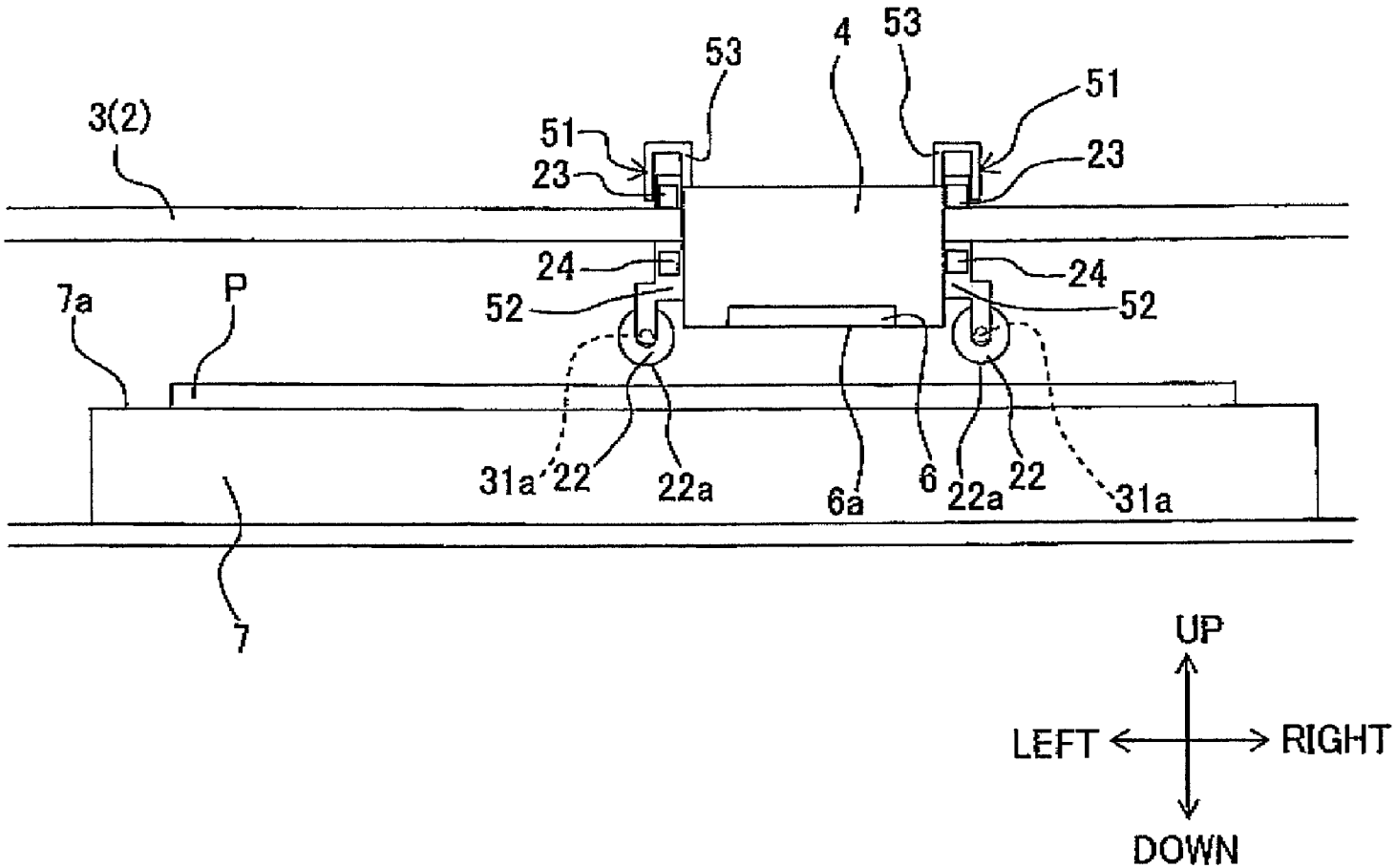
FIG. 6 shows a second modified embodiment corresponding to FIG. 2.

In a second modified embodiment, as shown in FIG. 6, second carriages 51 are arranged separately on the both sides of the first carriage 4 in relation to the left-right direction. Each of the second carriages 51 is provided with a support member 52 which has approximately the same shape as that of the support section 31 described above (see FIG. 2). Rollers 22 are rotatably supported by shafts 31*a* of the support members 52. The support members 52 are provided with protrusions 23, 24 at the same or equivalent positions as those of the support sections 31.

The first carriage 4 is provided with interposing sections 53 at both end portions in relation to the left-right direction to interpose the support members 52 in the left-right direction with respect to the first carriage 4.

In this arrangement, when the first carriage 4 is moved rightwardly, the right support member 52 is pushed by the right side surface of the first carriage 4. Accordingly, the right second carriage 51 is moved rightwardly. Further, the left support member 52 is pushed by the left interposing section 53, and thus the left second carriage 51 is moved rightwardly. On the contrary, when the first carriage 4 is moved leftwardly, the left support member 52 is pushed by the left side surface of the first carriage 4. Accordingly, the left second carriage 51 is moved leftwardly. Further, the right support member 52 is pushed by the right interposing section 53, and thus the right second carriage 51 is moved leftwardly.

Third Modified Embodiment

In the embodiment described above, both of the rollers 22, which are arranged on the both sides in relation to the left-right direction of the first carriage 4, extend over the range R1 which is wider than the range R2 in which the nozzles 15 are arranged, in relation to the front-back direction. However, the present invention is not limited thereto.

Figure 7:
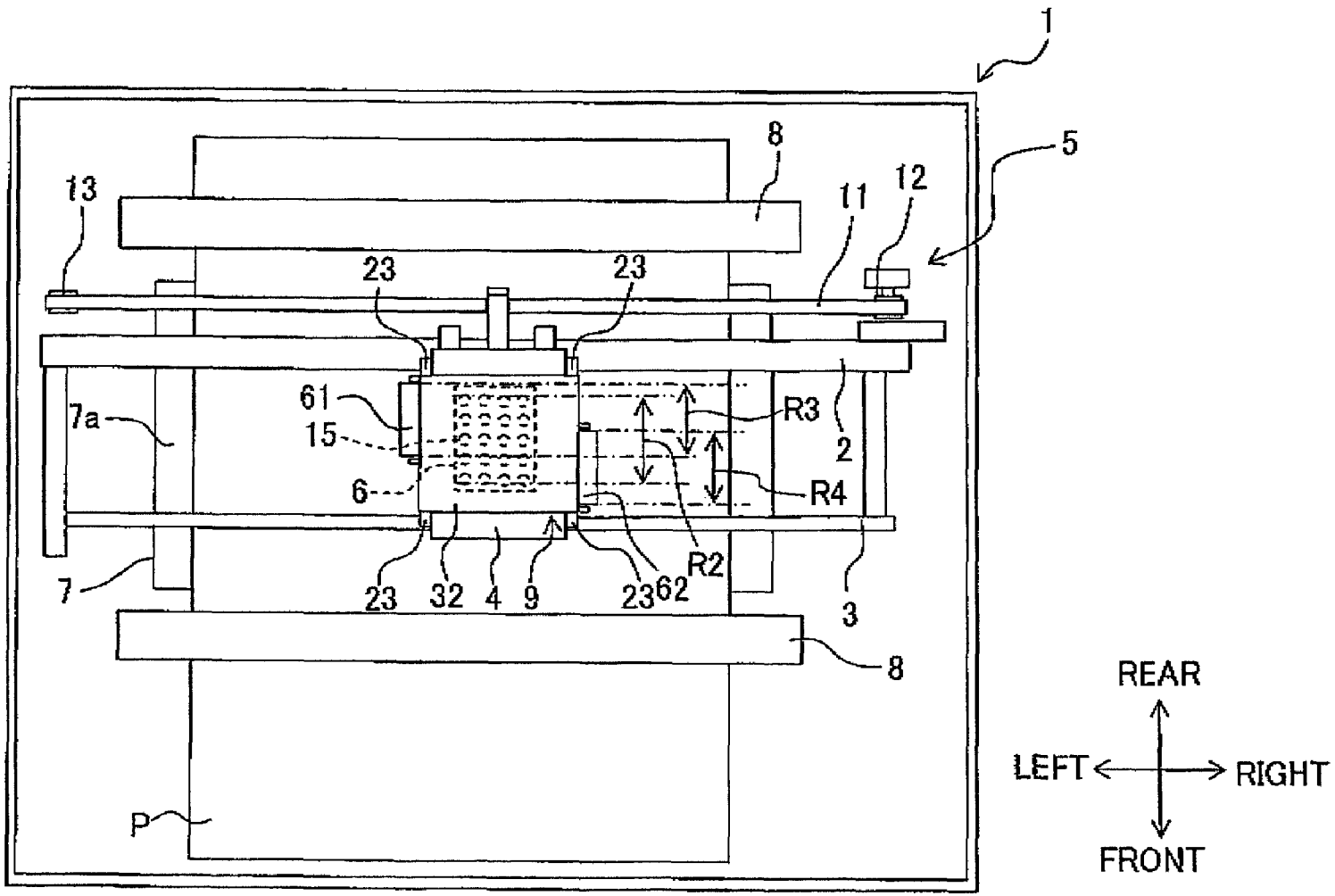
FIG. 7 shows a third modified embodiment corresponding to FIG. 1.

In a third modified embodiment, as shown in FIG. 7, a roller 61 arranged on the left side of the first carriage 4 and a roller 62 arranged on the right side of the first carriage 4 extend over only a range R3 and a range R4 which are narrower than the range R2 in which the nozzles 15 are arranged, in relation to the front-back direction, respectively. However, a range, which is obtained by combining the two ranges R3, R4, is wider than the range R2.

Also in this case, when the portion of the recording paper P, which is opposed to the nozzles 15, is bent or curled, for example, due to the swelling, the portion is brought in contact with any one of the two rollers 61, 62. Therefore, it is possible to prevent the recording paper P from being brought in contact with the jetting surface 6*a*.

In the third modified embodiment, the range, which is obtained by combining the ranges R3, R4 in which the two rollers 61, 62 are arranged, is wider than the range R2 in which the nozzles 15 are arranged, in relation to the front-back direction. However, the present teaching is not limited to such an arrangement. For example, the range, which is obtained by combining the ranges in which the rollers arranged on the both left and right sides of the first carriage are arranged, may be narrower than the range in which the nozzles 15 are arranged, in relation to the front-back direction.

In the embodiment and the modified embodiments thereof described above, the rollers 22 are arranged one by one on the both sides in relation to the left-right direction of the first carriage 4 (ink-jet head 6). However, the present teaching is not limited to such an arrangement. For example, a plurality of rollers, which are aligned in the front-back direction, may be arranged respectively on the both sides in relation to the left-right direction of the first carriage 4. It is desirable that the roller is formed of a material having a high water-repellent property. The term "high water-repellent property" means the fact that the wetting angle of the ink is large on the roller surface. For example, the roller may be formed of polypropylene. An appropriate water-repellent treatment may be applied to the surface of the roller. The shape of the surface of the roller is not limited to the flat shape. It is possible to adopt any arbitrary shape, if necessary. For example, spur-shaped protrusions/recesses may be formed on the surface as on a spur roller.

In the embodiment and the modified embodiments thereof described above, the rollers 22 are arranged respectively on the both sides in relation to the left-right direction of the first carriage 4 (ink-jet head 6). However, the present teaching is not limited to such an arrangement. For example, the roller 22 may be arranged on only one side in relation to the left-right direction of the first carriage 4.

In the embodiment and the modified embodiments thereof described above, the members (protective members) of the second carriage 9, which make contact with the curled recording paper P, are the rollers 22 which are rotatably supported by the shafts 31*a*. However, the present teaching is not limited to such an arrangement. For example, the protective member, which makes contact with the curled recording paper P, may be a member which does not have any rotatable movable portion, for example, a member which is constructed integrally with the frame 21. Specifically, the protective member may be a member made of resin which protrudes toward the transport surface 7*a* as compared with the jetting surface 6*a*, and the member may have a shape of, for example, rib, protrusion, or sphere. Alternatively, the protective member may be a member having a nearest portion, and only the nearest portion may be composed of a material having a small coefficient of friction with respect to the recording paper P.

In the embodiment and the modified embodiments thereof described above, the movement of the second carriage 9 is regulated by the abutment of the protrusions 23, 24 against the guide rails 2, 3. However, the present teaching is not limited to such an arrangement. Any member, against which the protrusions 23, 24 abut, may be provided for the printer 1 distinctly from the guide rails 2, 3.

In the embodiment and the modified embodiments thereof described above, the first carriage 4 is reciprocatively movable in the left-right direction along the two guide rails 2, 3 while being supported by the two guide rails 2, 3. However, the present teaching is not limited to such an arrangement. The first carriage 1 may be constructed such that the first carriage 1 is reciprocatively movable in the left-right direction along one guide bar.

In this arrangement, when the force in the upward direction is allowed to act on the first carriage, the first carriage is rotated about the axis of the guide bar. In this situation, the direction of movement of the first carriage has a component directed in the upward direction (separating direction to make separation from the transport surface in the third direction). Therefore, also in this arrangement, it is possible to prevent the first carriage from being moved in the separating direction to make separation from the transport surface of the recording paper when the recording paper P is curled or wrinkled, by providing the second carriage provided with the rollers 22 in the same manner as in the embodiment described above.

In the embodiment and the modified embodiments thereof described above, the second carriage 9 is constructed such that the second carriage 9 is reciprocatively movable in the left-right direction while following the movement of the first carriage 4 by being pushed by the first carriage 4. However, the present teaching is not limited to such an arrangement. For example, the second carriage 9 may be connected to any moving mechanism distinct from the moving mechanism 5, and the second carriage 9 can be moved in the left-right direction by means of the moving mechanism.

In the embodiment and the modified embodiments thereof described above, the recording paper P is transported along the transport surface 7*a* which is the upper surface of the platen 7. However, it is also allowable that the platen 7 is not provided. In this arrangement, the recording paper P is transported on the transport surface 7*a* by being transported by the transport rollers 8.

In the embodiment and the modified embodiments thereof described above, the jetting surface 6*a* is parallel to the transport surface 7*a*. However, the present teaching is not limited thereto. The jetting surface 6*a* may be inclined with respect to the transport surface 7*a*.

What is claimed is:

1. An ink-jet recording apparatus which jets liquid droplets of an ink onto a medium to perform recording, comprising:

an ink-jet head having a jetting surface on which a plurality of nozzles through which the ink is jetted is formed;

a first carriage on which the ink-jet head is mounted;

a guide member which extends in a first direction parallel to the jetting surface;

a moving mechanism which reciprocatively moves the first carriage in the first direction along the guide member;

a transport mechanism which transports the medium in a second direction perpendicular to the first direction along a transport surface which faces the jetting surface and which is parallel to the first direction; and a second carriage which is reciprocatively movable in the first direction while following movement of the first carriage and which is relatively movable in a third direction perpendicular to the transport surface with respect to the first carriage, the second carriage including:

a protective member which is arranged on one side of the ink-jet head in the first direction to protect the jetting surface from the medium; and a regulating member which regulates movement of the second carriage in the third direction so that a nearest portion of the protective member, which is provided with respect to the transport surface, is always disposed nearer to the transport surface as compared with the jetting surface in the third direction.

2. The ink-jet recording apparatus according to claim 1, wherein a first distance, which is provided in relation to the third direction between the jetting surface and the nearest portion of the protective member under a condition that the protective member most closely approaches the transport surface, is greater than a second distance which is provided in relation to the third direction and by which the second carriage is relatively movable with respect to the first carriage.

3. The ink-jet recording apparatus according to claim 1, wherein the protective member is a roller which is rotatably supported by a shaft extending in the second direction.

4. The ink jet recording apparatus according to claim 1, wherein the protective member is arranged in a range which is wider than a range in which the nozzles are arranged, in relation to the second direction.

5. The ink-jet recording apparatus according to claim 1, wherein the regulating member has an contacting portion which abuts against the guide member to regulate movement of the second carriage in relation to the third direction.

6. The ink-jet recording apparatus according to claim 1, wherein the protective member includes a pair of protective members provided on both sides of the ink-jet head in relation to the first direction.

7. The ink-jet recording apparatus according to claim 1, further comprising a biasing member which is supported by the first carriage and which biases the second carriage in a separating direction to make separation from the transport surface in relation to the third direction.

8. The ink-jet recording apparatus according to claim 1, wherein the second carriage has an abutment surface which abuts against a side surface of the first carriage in the first direction, and the abutment surface and the side surface of the first carriage are constructed slidably in the third direction.

9. The ink-jet recording apparatus according to claim 3, wherein a surface of the roller is formed of a material having a high liquid-repellent property with respect to the ink.

10. The ink-jet recording apparatus according to claim 5, wherein the contacting portion abuts against the guide member from a side of the transport surface to regulate movement of the second carriage in a separating direction to make separation from the guide member in relation to the third direction.

11. The ink-jet recording apparatus according to claim 6, wherein the second carriage further includes a connecting member which connects the pair of the protective members arranged on the both sides of the ink-jet head in relation to the first direction.

12. The ink-jet recording apparatus according to claim 10, wherein the second carriage is arranged to overlap a part of the first carriage in relation to the third direction; and the first carriage is regulated for movement in the separating direction to make separation from the guide member by the second carriage regulated for the movement in the separating direction to make separation from the guide member.

* * * * *